US008157716B2

(12) United States Patent
Madsen

(10) Patent No.: US 8,157,716 B2
(45) Date of Patent: Apr. 17, 2012

(54) CENTRIFUGAL SEPARATOR FOR RECOVERY OF KINETIC ENERGY FROM A DISCHARGED LIQUID

(75) Inventor: Bent Madsen, Gentofte (DK)

(73) Assignee: Alfa Laval Corporate AB, Lund (SE)

( * ) Notice: Subject to any disclaimer, the term of this patent is extended or adjusted under 35 U.S.C. 154(b) by 0 days.

(21) Appl. No.: 12/937,626

(22) PCT Filed: Apr. 15, 2009

(86) PCT No.: PCT/DK2009/050085

§ 371 (c)(1),
(2), (4) Date: Oct. 13, 2010

(87) PCT Pub. No.: WO2009/127212

PCT Pub. Date: Oct. 22, 2009

(65) Prior Publication Data

US 2011/0039680 A1 Feb. 17, 2011

(30) Foreign Application Priority Data

Apr. 16, 2008 (DK) ..... 2008 00555

(51) Int. Cl.
*B04B 11/02* (2006.01)
*B04B 1/20* (2006.01)

(52) U.S. Cl. ..... 494/56; 494/53

(58) Field of Classification Search ..... 494/53–54, 494/56–57; 210/380.1, 380.3
See application file for complete search history.

(56) References Cited

U.S. PATENT DOCUMENTS

| | | | | |
|---|---|---|---|---|
| 3,858,794 | A * | 1/1975 | Nilson et al. | 494/4 |
| 4,295,600 | A | 10/1981 | Saget | |
| 4,615,690 | A | 10/1986 | Ecker | |
| 5,885,202 | A * | 3/1999 | Ostkamp | 494/25 |
| 7,022,061 | B2 * | 4/2006 | Leung et al. | 494/56 |
| 7,326,169 | B2 * | 2/2008 | Bruning et al. | 494/56 |
| 2004/0072667 | A1 * | 4/2004 | Leung et al. | 494/56 |
| 2004/0072668 | A1 * | 4/2004 | Leung | 494/56 |
| 2005/0164861 | A1 | 7/2005 | Bruning et al. | |

(Continued)

FOREIGN PATENT DOCUMENTS

DE 3112585 A1 3/1981

(Continued)

OTHER PUBLICATIONS

Search Report of DK PA 200800555 dated Nov. 24, 2008.

(Continued)

*Primary Examiner* — Charles E Cooley
(74) *Attorney, Agent, or Firm* — Michaud-Kinney Group LLP

(57) ABSTRACT

The centrifugal separator comprises a rotatable bowl having a separation chamber defined by a base. The base comprises a first outlet opening defined by a weir at a first level. An outlet chamber communicates with the separation chamber through a first outlet opening. The outlet chamber is connected with an outlet opening, which opens at a second level below the first level into an exterior of the bowl. The outlet chamber outlet opening is provided with an outlet nozzle with an outlet direction opposite the direction of rotation, and an overflow inlet opening is present in the outlet chamber, and is placed at a third level between the first and the second level. The overflow inlet opening communicates with an overflow outlet opening, that opens into the exterior of the bowl.

16 Claims, 4 Drawing Sheets

U.S. PATENT DOCUMENTS

2011/0039680 A1* 2/2011 Madsen ..... 494/56

FOREIGN PATENT DOCUMENTS

| | | | | |
|---|---|---|---|---|
| DE | 3112585 | | | 10/1982 |
| DE | 3728901 | C1 | | 11/1988 |
| DE | 3822983 | A1 | * | 1/1990 |
| DE | 3904151 | | | 8/1990 |
| DE | 3904151 | A1 | | 8/1990 |
| EP | 0574364 | A1 | | 5/1993 |
| EP | 1480754 | A1 | | 3/2003 |
| WO | 2004035220 | A1 | | 4/2004 |
| WO | 2004035221 | A1 | | 4/2004 |
| WO | WO 2004035220 | A1 | * | 4/2004 |
| WO | 2005084814 | A1 | | 5/2005 |
| WO | 2005084814 | | | 9/2005 |
| WO | WO 2009127212 | A1 | * | 10/2009 |

OTHER PUBLICATIONS

International Search Report and Written Opinion for PCT/DK2009/050085, dated Jul. 9, 2009.

* cited by examiner

CENTRIFUGAL SEPARATOR FOR RECOVERY OF KINETIC ENERGY FROM A DISCHARGED LIQUID

FIELD OF THE INVENTION

The present invention relates to a centrifugal separator comprising: a bowl rotatable about an axis of rotation, said axis of rotation extending in a longitudinal direction of said bowl, a radial direction extending perpendicular to the longitudinal direction; a separation chamber in the bowl; a base provided at a rear longitudinal end of the bowl to define the separation chamber, said base comprising a first outlet opening defined in the radial direction at a first level by a weir, and said base defining a rear longitudinal area of the centrifugal separator; an outlet chamber communicating with the separation chamber through the first outlet opening; the outlet chamber being connected with an outlet chamber outlet opening, which is opening at a second level below the first level into an exterior of the bowl in a second longitudinal area in front of the rear longitudinal area.

BACKGROUND

A known centrifugal separator of this art is indicated in FIGS. 1, 2, 2*a* and 2*b* of the present specification.

Generally in a centrifugal separator a feed containing two or more phases is separated into individual phases, e.g. a solid or heavy phase and a liquid phase. A liquid phase may comprise a heavy liquid phase and a light liquid phase. A solid phase may by means of a screw conveyor be transported to an outlet at a front end of the separator while the liquid phase flows to an outlet at the rear end of the separator.

In a centrifugal separator the feed is accelerated to high velocities, the material closest to the circumference of the bowl having the highest velocity and thus the highest kinetic energy. Discharging material from the bowl at a position close to the circumference therefore entails a great loss of energy. To recover this energy two means are provided: The first means is discharging the material from the bowl at a position close to the axis of rotation, and the second means is ejecting the material with a relative velocity in a direction opposite to the direction of rotation; thus the material is discharged with a relatively small absolute velocity.

DE-A-39 04 151 discloses a centrifugal separator, in which the base is provided by a double wall with a ring chamber between the two walls of the double wall. A circumferential wall of the ring chamber, placed between the two walls of the double wall, is provided with two outlet nozzles. A concentric hole is provided in the wall closest to the separation chamber thereby providing the first weir at a first level. Openings are provided in the other wall, said openings being partially covered by adjustable weir members defining overflow outlet openings at a second level above the first level. Thus the overflow outlet openings open into a rear longitudinal area defined by the base, while the outlet nozzles open into another longitudinal area in front of the rear longitudinal area. The outlet nozzles in the circumferential wall are dimensioned to discharge 80-90% of the liquid phase volume during full load operation. At the end of the bowl opposite the base a solid phase outlet is provided at a level between the first and the second level. Hereby is obtained that during start-up the separator may be run at partial load and with a level of liquid inside the bowl rising to the first level i.e. below the level of the solid phase outlet. Thus there is no risk that liquid phase will exit through the solid phase outlet during the start-up. When an amount of solid phase has build-up at the solid phase outlet, thus blocking out the liquid phase from the solid phase outlet, the feed rate may be raised to full load, the level of liquid rising to the second level. This possibility of running the separator with two different levels of liquid inside the bowl is the purpose of the double wall construction. To recover energy the outlet nozzles are directed obliquely opposite the direction of rotation. In this prior art separator a part of the liquid phase is discharged relatively close to the axis of rotation in the area rear of the bowl.

DE-A-31 12 585 discloses a centrifugal separator with a horizontal axis of rotation and a liquid phase outlet at one end. In one embodiment the liquid phase outlet is provided as two successive annular outlet or collecting chambers separated from a separation chamber of the separator and from each other by identical annular discs. Curved outlet pipes with outlet nozzles are connected to circumferential walls of the collecting chambers to discharge liquid in a direction opposite the direction of rotation of the separator. Due to the fact that the annular discs are identical, liquid phase will flow at a first level above the inner annular edge of the first annular disc into the first collection chamber from the separation chamber to be discharged through the curved outlet pipe(s) connected to that collecting chamber. If the first collection chamber runs full due to excessive liquid phase flow, an excess part of the liquid phase will flow across the first collection chamber and into the second collection chamber. At this time the liquid phase in the separation chamber adjacent the first annular disc has risen above the first level to provide a pressure head driving the liquid phase across the first collection chamber.

Discharging material from the bowl at a position close to the axis of rotation is for practical reasons only possible if the material is discharged into the rear area, which is rear of the bowl and defined by the base of the bowl. In some instances it is not possible to discharge a liquid phase into this rear area.

SUMMARY

The object of the present invention is to provide for recovery of kinetic energy from a liquid phase being discharged in an area in front of the rear area defined by the base of the bowl.

This is obtained by a centrifugal separator wherein the outlet chamber outlet opening is provided with an outlet nozzle with an outlet direction having a component opposite the direction of rotation, and that an overflow inlet opening is present in the outlet chamber, which overflow inlet opening is placed at a third level between the first and the second level, and the overflow inlet opening communicates with an overflow outlet opening, which is opening into the exterior of the bowl in the second longitudinal area. Hereby is obtained that liquid or a liquid phase exiting from the outlet chamber outlet opening will exit with a relative velocity opposite the direction of rotation. Due to a restricted cross sectional area of a flow passage in the nozzle the liquid will rise in the outlet chamber to provide for an enhanced pressure upstream of the nozzle, which in turn provides for a larger velocity of the exiting liquid. The overflow inlet and outlet communicating with the outlet chamber ensures that the liquid in the outlet chamber will not rise above the first level. Rising of the liquid above the first level would entail a rise of the liquid level in the separation chamber, which would influence the process in the separation chamber. Such influence is often unwanted because it may be detrimental to the control of the process in the separation chamber. According to the invention the weir will generally define the level of a liquid phase inside the separation chamber.

To ensure that the liquid in the outlet chamber does not rise above the first level the overflow and thus the third level is preferably placed at least 5 mm below the first level, more preferably at least 10 mm below the first level and most preferably at least 15 mm below the first level.

On the other hand, to ensure that the liquid rises in the outlet chamber thus providing for more energy recovery, the overflow and thus the third level is preferably at most 50 mm below the first level, more preferably at most 30 mm below the first level and most preferably at most 25 mm below the first level.

In a preferred embodiment the overflow inlet opening connects the outlet chamber with a second outlet chamber through which the overflow inlet opening communicates with the overflow outlet opening, said outlet opening being provided with a second outlet nozzle, which second outlet nozzle has an outlet direction having a component opposite the direction of rotation. Hereby is obtained that energy is recovered also from liquid exiting through the overflow.

In a further preferred embodiment a second overflow is present in the second outlet chamber at a fourth level below the third level. By providing a further overflow, ensuring that the combined overflow will have a sufficient capacity, allows the second outlet nozzle to have a restricted cross sectional area whereby liquid may rise in the second outlet chamber to provide for an enhanced pressure upstream of the second outlet nozzle and thus a larger recovery of energy. This is relevant when the separator is run with a feed comprising a varying amount of the liquid phase that is discharged through the first outlet opening.

The present invention also resides in a centrifugal separator, wherein a second outlet with a second outlet opening is present in the base connecting the separation chamber with the exterior of the bowl in the rear longitudinal area at a fifth level different from the first level. Preferably the second outlet comprises a second weir defining during operation a level of a second liquid phase inside the separation chamber. Having first and second outlet openings at different levels provides for separating the liquid into two liquid phases of different density. Such different liquid phases are discharged in different longitudinal areas, and thus the liquid phase exiting through the first outlet cannot be discharged into the rear area rear of the bowl. Instead the liquid phase exiting through the first outlet is as previously stated discharged in a second longitudinal area in front of the rear longitudinal area.

In an embodiment, wherein the bowl, including its base, has a circumferential wall, the outlet nozzle, and the second outlet nozzle if present, is provided on an outer surface of said circumferential wall.

In a further embodiment, wherein the base is provided by a sufficiently thick wall member, the outlet chamber is recessed in said wall member. Further in this embodiment the outlet chamber may be connected with the outlet chamber outlet opening through a bore in the wall member. A second bore in the wall member may provide a second outlet chamber.

In still another embodiment, at least one of the first and the second nozzle is provided in a nozzle member placed on the circumference of the bowl.

In an embodiment the first and/or the second weir is provided by an exchangeable and/or shiftable weir member. This provides for adjusting the first level in the separation chamber and/or the fifth level.

BRIEF DESCRIPTION OF DRAWINGS

The invention will now be explained in further detail by way of example with reference to the drawings.

DETAILED DESCRIPTION OF EMBODIMENT

Figure 1:
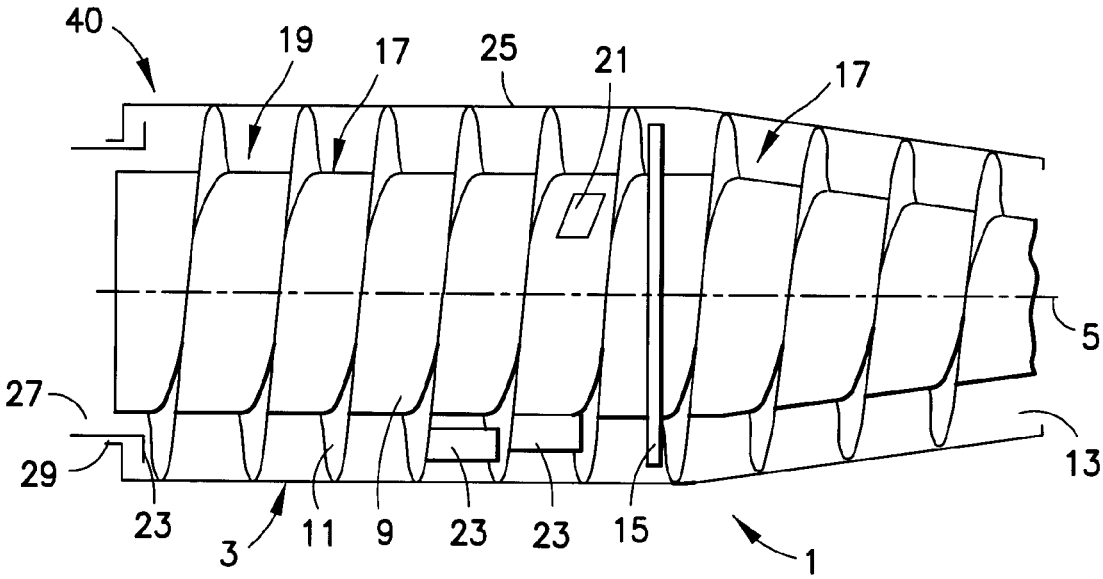
FIG. 1 PRIOR ART
FIG. 1 illustrates a centrifuge.

FIG. 1 shows schematically a centrifugal separator or centrifuge 1 to which the present invention may be applied. The centrifuge 1 comprises a drum or bowl 3, which during operation rotates around a longitudinal axis of rotation 5 extending in a longitudinal direction of the bowl. In the bowl 3 a screw conveyor 7 is provided, said screw conveyor comprising an elongated body 9 carrying a worm 11 for transporting a solid phase of material separated in the centrifuge towards a solid phase outlet 13. A baffle plate 15 divides the interior of the bowl 3 into a solid phase outlet section 17 and a separation chamber 19. The elongated body 9 comprises an inlet 21 for material to be separated by the centrifuge. Inside the separation chamber 19 barrier plates 23 are provided to enable separation of a liquid phase of material in the separation chamber 19 into a light liquid phase and a heavy liquid phase. Due to differences in density the heavy liquid phase will be placed closer to the circumferential wall 25 of the bowl than the light liquid phase, and it is possible to recover the light and the heavy liquid phase separately through a light phase outlet 27 and a heavy phase outlet 29, respectively, placed at different radial distances from the axis of rotation 5. The centrifuge 1 described so far is disclosed in further detail in WO-A-2005/084814 incorporated herein by reference.

Figure 2A:
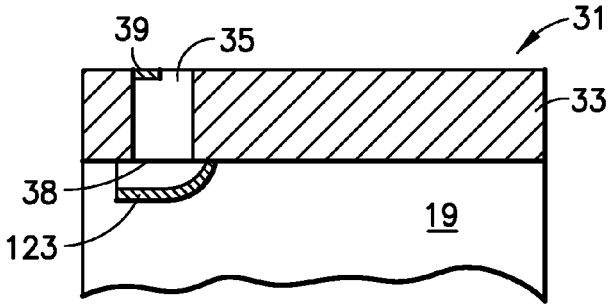
FIG.2a PRIOR ART
FIG. 2*a* shows a section along 2*a* -2*a* in FIG. 2
Figure 2:
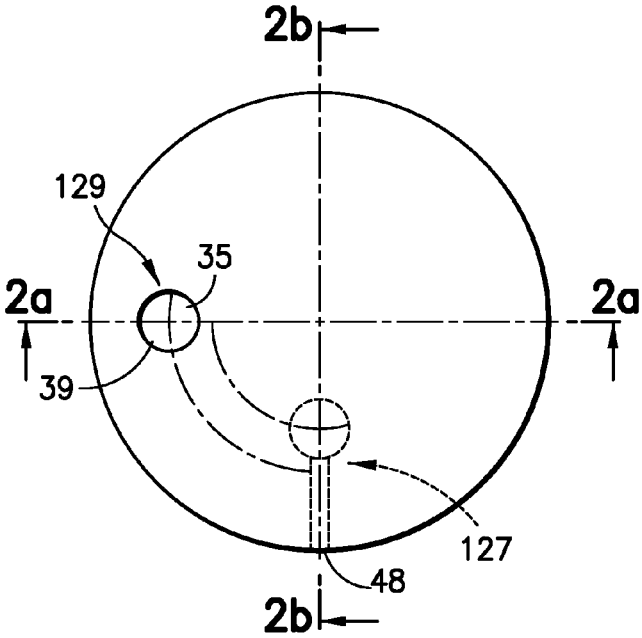
FIG.2 PRIOR ART
FIG. 2 shows a base of a prior art centrifuge bowl.
Figure 2B:
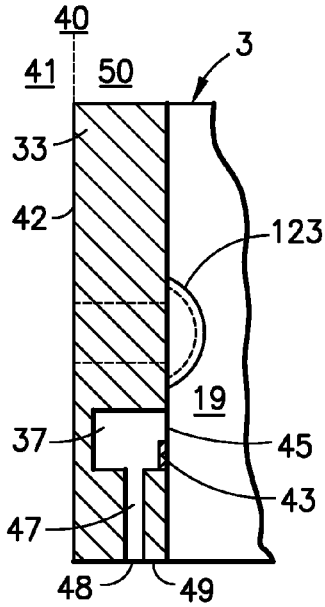
FIG.2b PRIOR ART
FIG. 2*b* shows a section along 2*b* -2*b* in FIG. 2

FIG. 1 does not show the base of the bowl 3 defining the separation chamber 19 longitudinally opposite the baffle plate 15. A base 31 according to prior art is schematically shown in FIGS. 2, 2*a* and 2*b*. The base 31 comprises a thick wall member 33 with a recess establishing an outlet chamber 37 of a first or light phase outlet 127 for light liquid phase and a through hole 35 establishing a second or heavy phase outlet 129 for heavy liquid phase. Though only one light phase outlet and one heavy phase outlet is shown in FIG. 2 it should be understood that preferably at least two of either are provided to obtain symmetry about the axis of rotation 5.

The heavy phase outlet 129 comprises a heavy phase outlet opening 38 in the separation chamber and a weir plate 39, which defines the heavy phase outlet radially and establishes the level of the heavy liquid phase inside the separation chamber 19. A barrier plate 123 shields the heavy phase outlet opening 38 from the light liquid phase. Liquid discharged through the heavy phase outlet is let out into the exterior 40 of the bowl in a rear longitudinal area 41 behind the wall member 33 of the bowl 3. The rear longitudinal area 41 is defined in the longitudinal direction by the rear side 42 of the wall member.

Herein the end of the bowl 3 comprising the solid phase outlet 13 has arbitrarily been defined as front end, and the end of the bowl comprising the liquid phase outlets 127, 129 has correspondingly been defined as rear end.

The light phase outlet 127 comprises, apart from the outlet chamber 37, a weir 43 defining radially a light phase outlet opening 45 in the separation chamber 19. The separation chamber 19 communicates with the outlet chamber 37 through the light phase outlet opening 45, and the weir 43 defines the level of light liquid phase in the separation chamber 19. The outlet chamber 37 communicates with the exterior 40 of the bowl 3 through a bore 47 in the wall member 33. The bore constitutes an extension of the outlet chamber and has an outlet chamber outlet opening 48 in a circumferential surface 49 of the wall member 33. The circumferential surface forms part of a circumferential wall of the bowl. The bore 47 has a diameter ensuring a flow capacity that exceeds all practical foreseeable loads of light liquid phase, since if the capacity was too small a risk would exist, that light liquid phase would rise or impounded in the bore 47 and the outlet chamber 37 above the level of the weir 43. This would entail a rise of the level of light liquid phase inside the separation chamber 19, which could have a detrimental influence on the process in the separation chamber.

Liquid exiting through the bore 47 enters a second longitudinal area 50 in front of the rear longitudinal area 41 i.e. another longitudinal area than the one, into which liquid exiting through the heavy phase outlet 129 enters. Thus it is possible to collect the liquid phases separately from the exterior 40 of the bowl 3 by providing in a manner known per se an appropriate casing for the bowl (not shown).

Figure 3A:
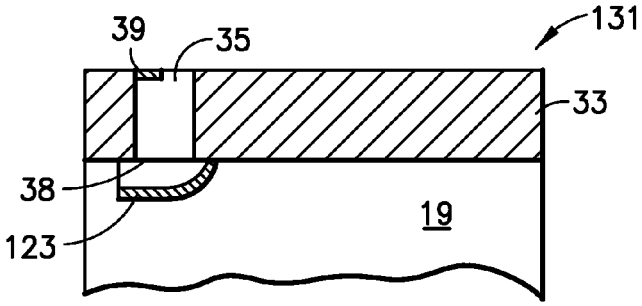
FIG. 3*a* shows a section along 3*a* -3*a* in FIG. 3
Figure 3:
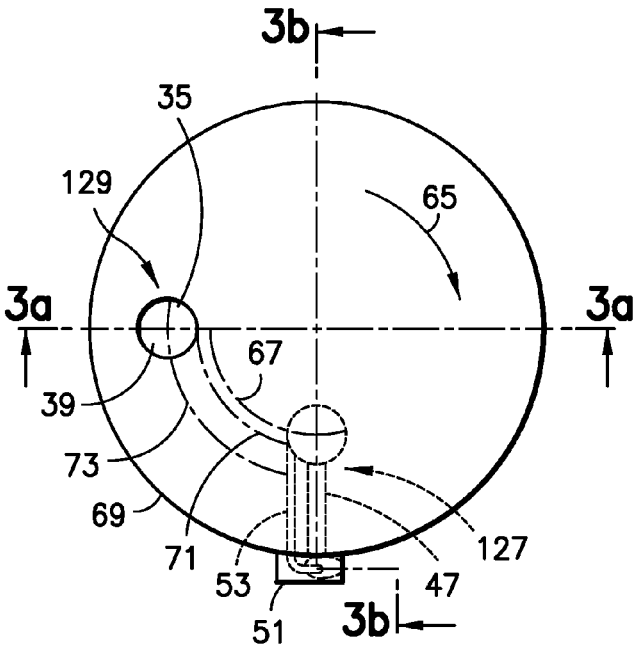
FIG. 3 shows a base of a centrifuge bowl according to the present invention
Figure 3B:
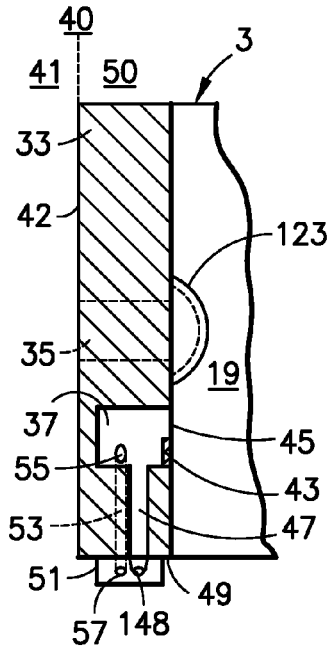
FIG. 3*b* shows a section along 3*b* -3*b* in FIG. 3.
Figure 4:
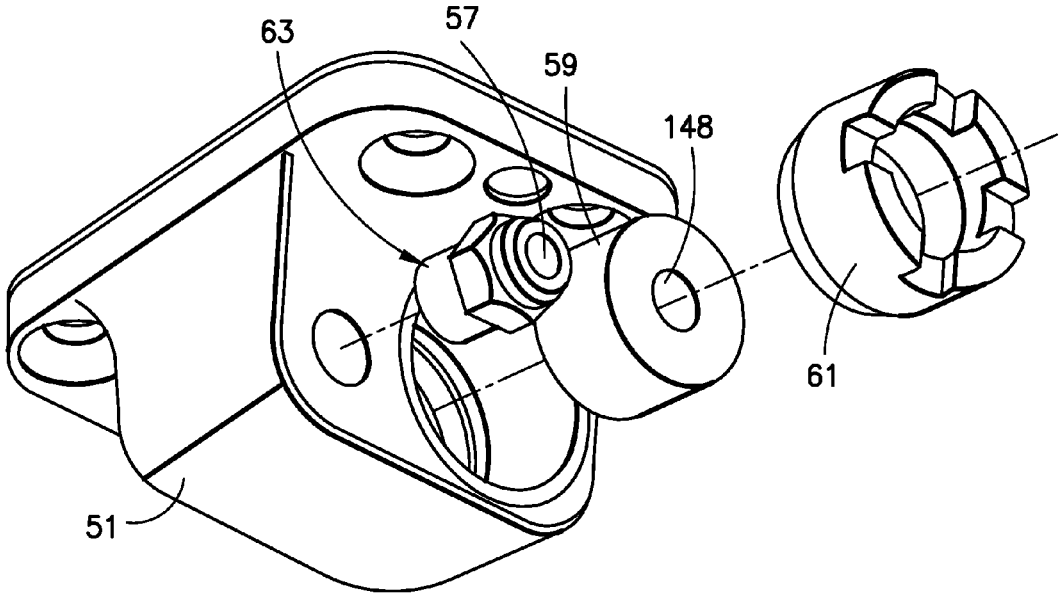
FIG. 4 shows a nozzle member.

FIGS. 3, 3*a* and 3*b* show a base 131 embodied in accordance with the present invention. Since the base 131 to a great extent corresponds to the base 31 shown in and discussed in relation to FIGS. 2, 2*a* and 2*b* like features are given identical reference numerals. Thus, apart from the features shown in FIGS. 2, 2*a* and 2*b*, the base 131 is provided with a nozzle member 51 and a second bore 53.

The second bore 53 provides an overflow inlet opening 55 in the outlet chamber 37 and connects this overflow inlet opening with an overflow outlet opening 57 adjacent an outlet chamber outlet opening 148 at the circumferential surface 49 of the wall member 33.

The nozzle member 51 adds respective bends to the first and the second bore 47 and 53 and it is provided with an exchangeable outlet nozzle 59 providing the outlet chamber outlet opening 148 and being secured to the nozzle member by an externally threaded bushing 61, and with an exchangeable, externally threaded second nozzle or overflow nozzle 63 providing the overflow outlet opening 57. Thus liquid passing through the first bore 47 will be discharged through the outlet nozzle 59, and liquid passing through the second bore 53 will be discharged through the overflow nozzle 63. When mounted the nozzles are directed tangentially to the base 31 opposite to a direction of rotation 65 of the bowl, cf. FIG. 3.

Herein directions "up" and "down" are used to denominate radial directions, perpendicular to the longitudinal direction, towards and away from the axis of rotation 5, respectively. The terms "high" and "low" are used correspondingly.

The first weir 43 is located a first level 67. The circumferential surface 49 of the base 131 is located at a lower second level 69. The overflow inlet opening 55 is located at a third level 71 close to, but below the first level 67.

During operation, a liquid phase, which with the present embodiment is the light liquid phase, rises inside the separation chamber 19 to the first level 67 where the liquid phase overflows the first weir 43. The light phase flows through the outlet chamber 37 down the bore 47 and out through the outlet nozzle 59. The outlet nozzle 59 is dimensioned so that in normal operation the light phase will be impounded, and the impounded liquid will provide a backpressure providing an enlarged velocity of the liquid discharged through the outlet nozzle 59 thereby providing for energy recovery. The level of impounded light phase will depend on the amount of light phase in the feed of the centrifuge and the feed rate. If the amount of light phase in the feed and/or the feed rate is large the level of impounded light phase in the outlet chamber 37 may reach the overflow inlet opening 55 into which the light phase will flow thereby avoiding that the level of impounded liquid rises to or above the first level 67.

In the second bore 53 the liquid may be impounded to a certain degree thus providing for a corresponding degree of energy recovery from the liquid passing through the overflow nozzle 63, as the liquid passing through the overflow nozzle is directed tangentially to the circumferential surface 49 of the base 131 in a direction opposite to the direction of rotation 65 like the liquid passing through the outlet nozzle 59.

It is foreseen that a second overflow may be introduced by providing a third bore beside the second bore 53, the third bore extending from a fourth level between the first level 67 and the third level 71 to the circumferential surface 49 of the base. Providing more overflows, which successively will become active provides for maximum energy recovery when the centrifuge is run with a varying flow of the liquid phase discharged through the outlet in question.

It should be understood that although in the present embodiment the light liquid phase is discharged through the first outlet 127 discussed above into the second longitudinal area 50 and the heavy liquid phase is discharged through the second outlet 129 into the rear longitudinal area 41, the opposite is also possible. The first outlet 127 provided by the outlet chamber 37 in the wall member 33 and the bores 47, 53 opening into the circumferential surface 49 of the wall member is positioned at the first level 67 defined by the weir 43, and the second outlet 129 provided by the through hole 35 in the wall member 33 is positioned at a fifth level 73 different from the first level and defined by the weir plate 39. In the present embodiment the two outlets 127, 129 are positioned so that the first level 67 is higher than the fifth level 73. This fact provided for the light liquid phase exiting through the first outlet 127 and the heavy liquid phase exiting through the second outlet 129.

If the mutual positions of the first and the second outlet were changed so that the first level was lower than the fifth level, then the light liquid phase would exit through the second outlet and the heavy liquid phase would exit through the first outlet.

It should be noted however that the barrier plate 123 shielding the heavy phase outlet from the light liquid phase should always be placed at the outlet positioned at the lower level.

The invention claimed is:

1. A centrifugal separator comprising:

a bowl rotatable about an axis of rotation extending in a longitudinal direction of said bowl, a radial direction extending perpendicular to the longitudinal direction;

a separation chamber in the bowl;

a base provided at a rear longitudinal end of the bowl to define the separation chamber, said base comprising a first outlet opening defined in the radial direction at a first level by a weir, and said base defining a rear longitudinal area of the centrifugal separator;

an outlet chamber communicating with the separation chamber through the first outlet opening;

the outlet chamber being connected with an outlet chamber outlet opening, which opens at a second level below the first level into an exterior of the bowl in a second longitudinal area in front of the rear longitudinal area, the outlet chamber outlet opening being provided with an outlet nozzle having an outlet direction having a component generally opposite a direction of rotation of the bowl, and wherein an overflow inlet opening is present in the outlet chamber, the overflow inlet opening being placed at a third level between the first and the second level, and the overflow inlet opening communicating with an overflow outlet opening, which opens into the exterior of the bowl in the second longitudinal area.

2. A centrifugal separator according to claim 1, wherein the overflow inlet opening connects the outlet chamber with a second outlet chamber through which the overflow inlet opening communicates with the overflow outlet opening, said outlet opening being provided with a second outlet nozzle, which second outlet nozzle has an outlet direction having a component opposite the direction of rotation.

3. A centrifugal separator according to claim 2, wherein the bowl has a circumferential wall and the outlet nozzle and the second outlet nozzle are provided on an outer surface of said circumferential wall.

4. A centrifugal separator according to claim 1, wherein a second outlet with a second outlet opening is present in the base connecting the separation chamber with the exterior of the bowl in the rear longitudinal area at a fifth level different from the first level.

5. A centrifugal separator according to claim 4, wherein the second outlet comprises a second weir defining, during operation, a level of a liquid phase inside the separation chamber.

6. A centrifugal separator according to claim 1, wherein the bowl has a circumferential wall and the outlet nozzle is provided on an outer surface of said circumferential wall.

7. A centrifugal separator according to claim 1, wherein the base is defined by a wall member, the outlet chamber being recessed in said wall member.

8. A centrifugal separator according to claim 7, wherein the outlet chamber is connected with the outlet chamber outlet opening through a bore in the wall member.

9. A centrifugal separator according to claim 7, wherein a second outlet chamber is provided by a second bore in the wall member.

10. A centrifugal separator according to claim 1, wherein the outlet nozzle is provided in a nozzle member placed on the circumference of the bowl.

11. A centrifugal separator according to claim 1, wherein the third level is at least 5 mm below the first level.

12. A centrifugal separator according to claim 11, wherein the third level is at least 10 mm below the first level.

13. A centrifugal separator according to claim 12, wherein the third level is at least 15 mm below the first level.

14. A centrifugal separator according to claim 1, wherein the third level is at most 50 mm below the first level.

15. A centrifugal separator according to claim 14 wherein the third level is at most 30 mm below the first level.

16. A centrifugal separator according to claim 15, wherein the third level is at most 25 mm below the first level.

* * * * *